US008678453B2

(12) United States Patent
Caliguri et al.

(10) Patent No.: US 8,678,453 B2
(45) Date of Patent: Mar. 25, 2014

(54) PORTABLE DOOR PROPPING APPARATUS AND METHODS

(75) Inventors: Nicholas P. Caliguri, Cleves, OH (US); Ronald L. Newcomb, Naples, FL (US)

(73) Assignee: Newcal LLC, Naples, FL (US)

( * ) Notice: Subject to any disclaimer, the term of this patent is extended or adjusted under 35 U.S.C. 154(b) by 0 days.

(21) Appl. No.: 13/428,010

(22) Filed: Mar. 23, 2012

(65) Prior Publication Data

US 2012/0248797 A1 Oct. 4, 2012

Related U.S. Application Data

(60) Provisional application No. 61/469,260, filed on Mar. 30, 2011.

(51) Int. Cl.
*E05C 19/18* (2006.01)
*E05C 17/54* (2006.01)

(52) U.S. Cl.
USPC ..... 292/288; 292/343

(58) Field of Classification Search
USPC ..... 292/288, 343
See application file for complete search history.

(56) References Cited

U.S. PATENT DOCUMENTS

| | | | | | |
|---|---|---|---|---|---|
| 423,343 | A * | 3/1890 | Renshaw | 292/343 |
| 1,951,418 | A * | 3/1934 | Jacobi | 70/360 |
| 3,703,742 | A * | 11/1972 | Konishi | 16/385 |
| 4,215,449 | A * | 8/1980 | Loikitz | 16/50 |
| 4,831,688 | A * | 5/1989 | Deininger | 16/319 |
| 4,864,834 | A * | 9/1989 | Waite | 70/14 |
| 5,027,471 | A * | 7/1991 | Barnes | 16/86 R |
| 5,711,557 | A * | 1/1998 | Nicolosi | 292/288 |
| 5,881,431 | A | 3/1999 | Pieper, II et al. | |
| 6,234,058 | B1 * | 5/2001 | Morgado | 89/33.03 |
| 2006/0032017 | A1 | 2/2006 | Agster et al. | |

OTHER PUBLICATIONS

"HingeHookz by AFS", Product ID: FMS-HKZ, Anclote Fire & Safety Inc., Tarpon Springs, Florida, U.S., shown on website http://www.anclotefire.com/proddetail.php?prod=FMS-HKZ, 3 pages. Retrieved Jan. 25, 2010.

"Wedge-it", Jaca Enterprises, Inc., Roseville, California, U.S., shown on website http://www.wedge-it.com/product_details.htm, 2 pages, 2006-2007. Retrieved May 1, 2012. Admitted to have been in public domain prior to Mar. 30, 2010.

"Hinge Hook", Identifier AM184, W.S. Darley & Co., Itasca, Illinois, U.S., shown on website http://www.edarley.com/finditem/11064, 1 page. Retrieved Jan. 25, 2010.

* cited by examiner

*Primary Examiner* — Kristina Fulton
*Assistant Examiner* — Thomas Neubauer
(74) *Attorney, Agent, or Firm* — Ulmer & Berne LLP

(57) ABSTRACT

A portable door propping apparatus includes a first arm, a second arm, and a coupling member. The first arm is pivotally coupled with the second arm. The portable door propping apparatus can be hung on a door hinge, to facilitate propping of the door in an opened position. Methods are also provided.

18 Claims, 9 Drawing Sheets

PORTABLE DOOR PROPPING APPARATUS AND METHODS

REFERENCE TO RELATED APPLICATION

The present application claims priority of U.S. provisional application Ser. No. 61/469,260, filed Mar. 30, 2011, and hereby incorporates the same application herein by reference in its entirety.

TECHNICAL FIELD

A portable door propping apparatus is provided, for hanging on a hinge of a door to prop the door in an opened position.

BACKGROUND

Conventional door stops or chocks are formed as a wedge-shaped block from wood or rubber, and can be wedged between a door and a ground surface, or between a door and a door frame, to temporarily maintain the door in an opened position.

SUMMARY

In accordance with one embodiment, a portable door propping apparatus comprises a first arm, a second arm, and a coupling member. The first arm comprises a first wing and a first hub. The first hub defines a first bore. The second arm comprises a second wing and a second hub. The second hub defines a second bore. The coupling member comprises a hinge pin and a hook. The hinge pin defines a hinge axis and extends into each of the first bore and the second bore. The first arm is pivotable relative to the second arm about the hinge axis, between an opened position and a closed position. When the first arm is in the closed position, the first wing and the second wing confront one another and together sandwich at least a portion of the hook.

In accordance with another embodiment, a portable door propping apparatus comprises a first arm, a second arm, and means for pivotally coupling the first arm with the second arm. The portable door propping apparatus further comprises means for facilitating hanging of the portable door propping apparatus on a door hinge.

In accordance with yet another embodiment, a method is provided of propping a door in an opened position relative to a door frame. The door is pivotally coupled to the door frame by at least one hinge. The method comprises pivoting a first arm of a portable door propping apparatus, from a closed position to an opened position, relative to a second arm of the portable door propping apparatus, about a hinge axis defined by a hinge pin of a coupling member of the portable door propping apparatus. The coupling member further comprises a hook extending into a space defined between the first arm and the second arm when the first arm is in the closed position. The method further comprises hanging the hook on the hinge such that the first arm abuts the door and the second arm abuts the door frame.

BRIEF DESCRIPTION OF THE DRAWINGS

It is believed that certain embodiments will be better understood from the following description taken in conjunction with the accompanying drawings in which.

DETAILED DESCRIPTION

Figure 1:
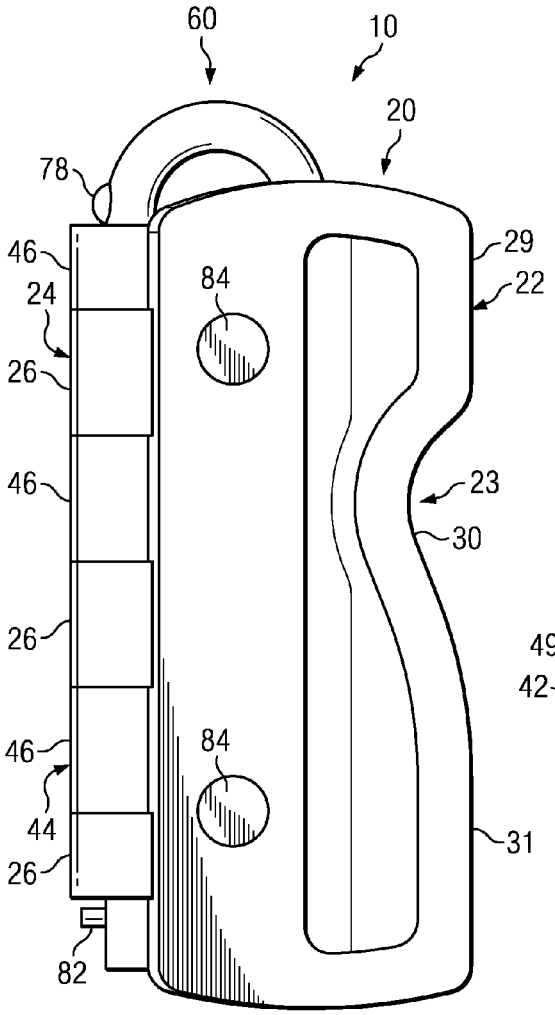
FIG. 1 is a right side elevational view depicting a portable door propping apparatus in accordance with one embodiment, wherein the portable door propping apparatus is in a closed position.

Selected embodiments are hereinafter described in detail in connection with the views and examples of FIGS. 1-14, wherein like numbers indicate the same or corresponding elements throughout the views.

A door stop or portable door propping apparatus 10 in accordance with one embodiment is described in connection with FIGS. 1-9. In one embodiment, the portable door propping apparatus 10 can include arms 20 and 40. The arm 20 can include a wing 22 and a hub 24 that can be formed as a unitary structure, such as through an injection molding process, for example. More particularly, the hub 24 can include one or more annular or barrel members 26 (e.g., three shown) spaced from one another longitudinally along a hinge axis "A" (FIG. 7) and each defining a respective portion of a bore 28. With reference to FIGS. 3-6, the arm 20 can extend vertically from a top edge 32 to a bottom edge 33 and horizontally from a side edge 34 to a side edge 35, with each of the top edge 32 and the bottom edge 33 extending to each of the side edges 34 and 35. In this configuration, the hub 24 defines at least a portion of the side edge 34.

The wing 22 can define one or more notches to facilitate grasping of the portable door propping apparatus 10 by a hand of an operator. For example, with reference to FIGS. 1 and 5, the side edge 35 of the arm 20 can define a notch 23. More particularly, the side edge 35 can include edge portions 29, 30 and 31, with the edge portion 30 separating and connecting the edge portions 29 and 31. The edge portions 29 and 31 can be generally straight and aligned with one another, with the edge portion 30 being curvilinear, as shown in FIG. 1.

The arm 40 can be similar to the arm 20. For example, the arm 40 can include a wing 42 and a hub 44 that can be formed as a unitary structure, such as through an injection molding process, for example. More particularly, the hub 44 can include one or more barrel members 46 (e.g., three shown) spaced from one another longitudinally along the hinge axis "A" (FIG. 7) and each defining a respective portion of a bore 48. With reference to FIGS. 3-6, the arm 40 can extend vertically from a top edge 52 to a bottom edge 53 and horizontally from a side edge 54 to a side edge 55, with each of the top edge 52 and the bottom edge 53 extending to each of the side edges 54 and 55. In this configuration, the hub 44 defines at least a portion of the side edge 54.

Figure 2:
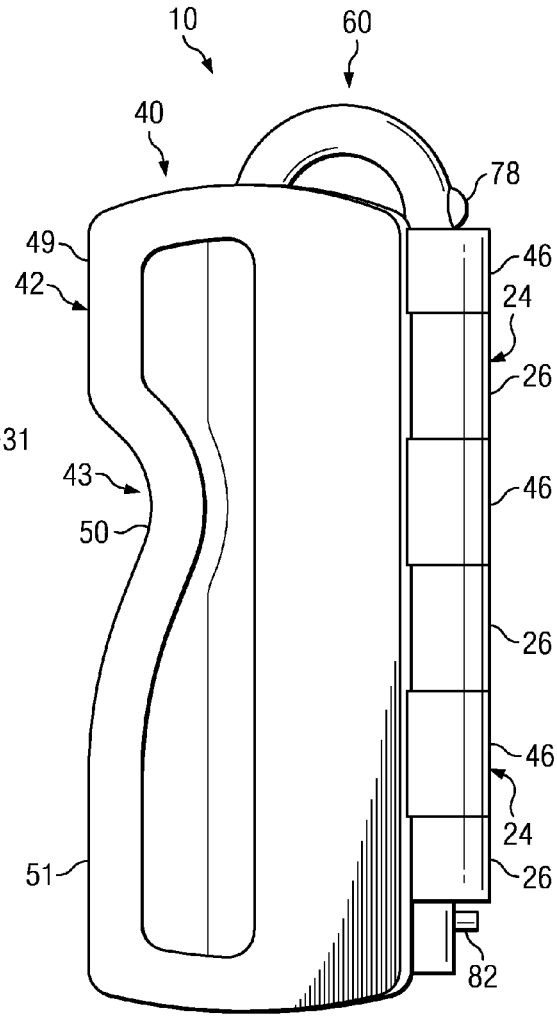
FIG. 2 is a left side elevational view depicting the portable door propping apparatus of FIG. 1.
Figure 3:
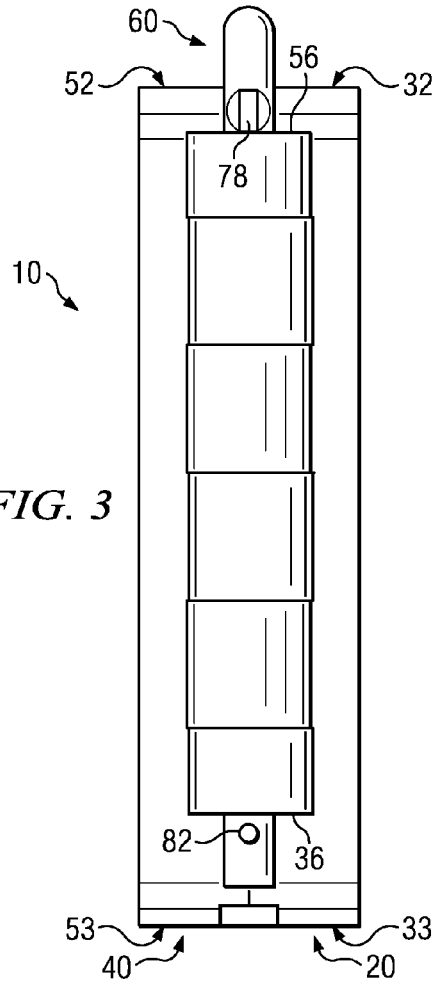
FIG. 3 is a front elevational view depicting the portable door propping apparatus of FIG. 1.
Figure 4:
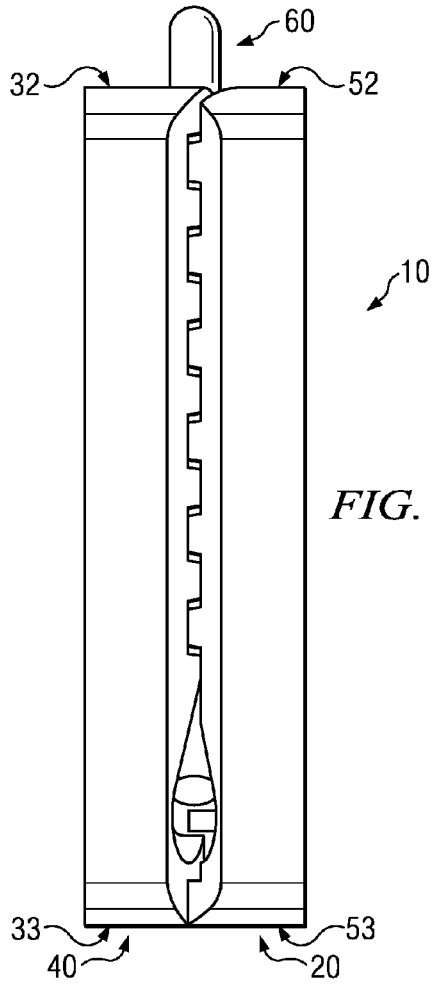
FIG. 4 is a rear elevational view depicting the portable door propping apparatus of FIG. 1.
Figure 5:
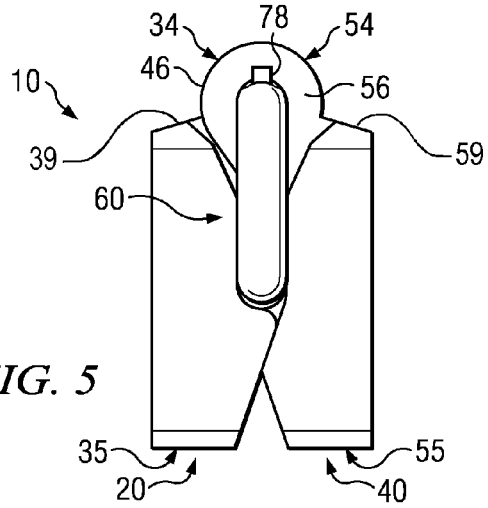
FIG. 5 is a top plan view depicting the portable door propping apparatus of FIG. 1.
Figure 6:
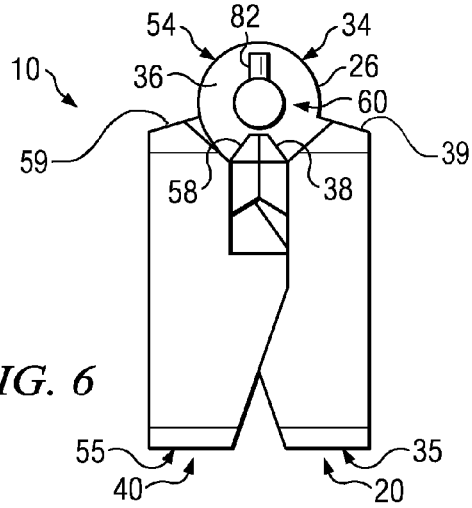
FIG. 6 is a bottom plan view depicting the portable door propping apparatus of FIG. 1.

As with the wing 22 of the arm 20, the wing 42 of the arm 40 can define one or more notches to facilitate grasping of the portable door propping apparatus 10 by a hand of an operator. For example, with reference to FIGS. 2 and 5, the side edge 55 of the arm 40 can define a notch 43. More particularly, the side edge 55 can include edge portions 49, 50 and 51, with the edge portion 50 separating and connecting the edge portions 49 and 51. The edge portions 49 and 51 can be generally straight and aligned with one another, with the edge portion 50 being curvilinear, as shown in FIG. 2.

The arms 20 and 40 can be formed from plastic, metal, wood, fiberglass, a composite, or any of a variety of other suitable materials which can be selected on the basis of strength, durability, weight, chemical and heat resistance and other characteristics and design objectives. For example, the arms 20 and 40 can be formed from plastic. The plastic can be embedded with glass, carbon, ceramic, fibers, and/or any of a variety of other suitable materials. In one particular embodiment, the arms 20 and 40 can be formed from fiberglass-reinforced plastic, in order to provide a combination of benefits relating to cost, weight, and strength. The fiberglass-reinforced plastic can have any of a variety of suitable colors, and can be configured to glow in the dark, to coincide with a particular use or customer.

In one embodiment, the portable door propping apparatus 10 can be formed from the fiberglass-reinforced plastic during an injection molding process, and to include any of a variety of structural features (e.g., suitable ribs, depressions, and reinforcement structures) such as shown in FIGS. 1-9. The selection and arrangement of these structural features can affect the strength of the portable door propping apparatus 10, the ability of the portable door propping apparatus 10 to be easily grasped by an operator, the ability of the portable door propping apparatus 10 to interact with various doors and door frames, the weight of the portable door propping apparatus 10, the functionality of the portable door propping apparatus 10, and the size of the portable door propping apparatus 10 when in both opened and closed positions, among other features of the portable door propping apparatus 10. It will be appreciated that a portable door propping apparatus 10 can be provided with any of a variety of structural features alternative to those shown in FIGS. 1-9. While the arm 20 can be formed from the same material as the arm 40, and with a shape and configuration generally complementary to that of the arm 40 as shown in FIGS. 1-9, in an alternative embodiment respective arms of a portable door propping apparatus can be formed differently. It will also be appreciated that arms of a portable door propping apparatus can be formed in any of a variety of alternative configurations to those shown.

The portable door propping apparatus 10 can also include one or more magnets. For example, FIG. 1 illustrates two magnets 84 attached to the wing 22 of the arm 20, such as with adhesive and/or by being insert molded or otherwise embedded in or received in an interference fit within respective recesses formed in the arm 20. It will be appreciated that, in alternative embodiments, a different quantity or arrangement of magnets might be provided, and associated with one or both arms of a portable door propping apparatus.

Figure 7:
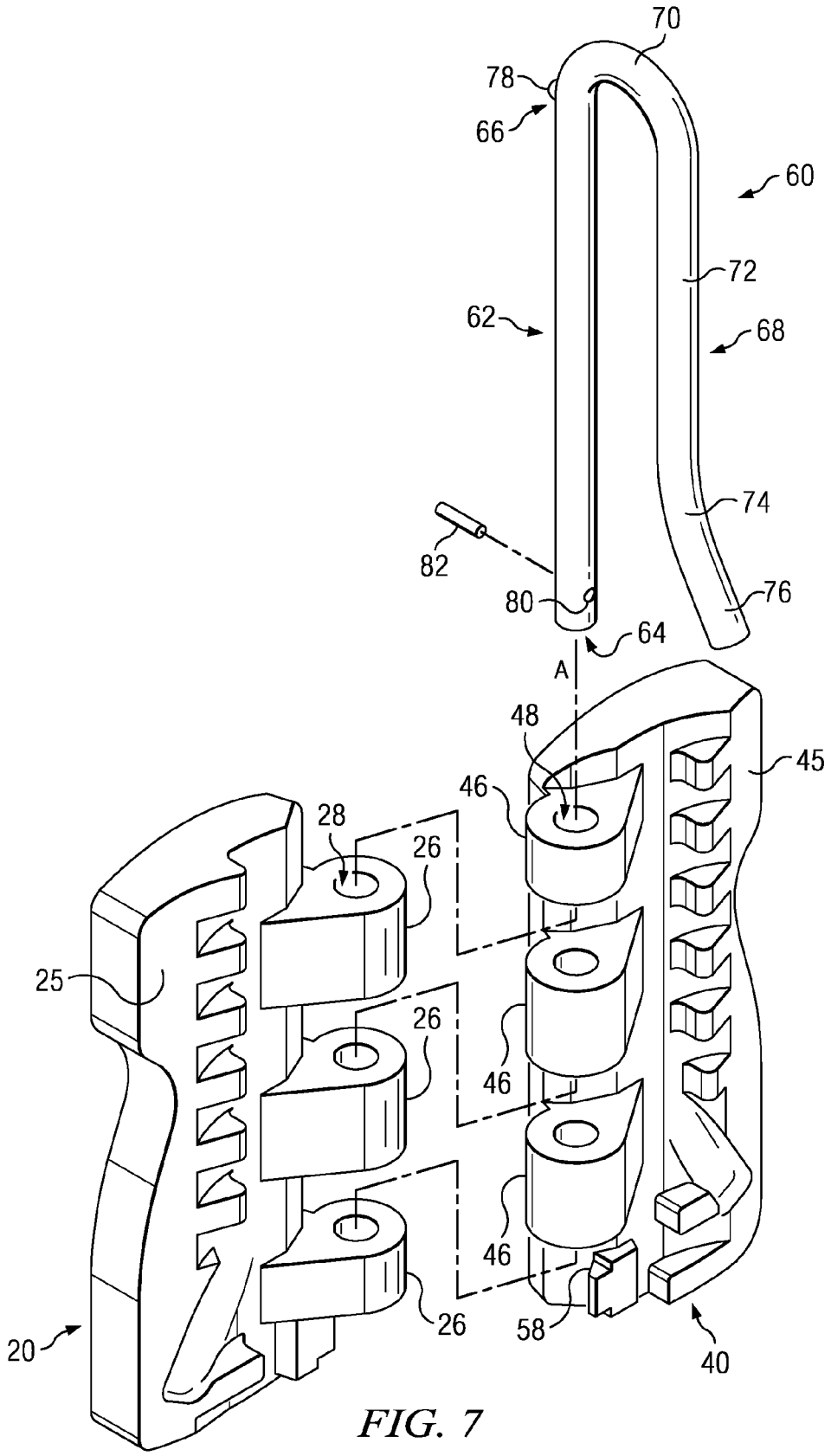
FIG. 7 is an exploded perspective view depicting the portable door propping apparatus of FIG. 1.

The portable door propping apparatus 10 can also include a coupling member 60. The coupling member 60 is shown in FIG. 7 to comprise a hinge pin 62 and a hook 68 that can be formed as a unitary structure from an elongated rod. The coupling member 60 can be formed from steel, such as hardened steel or stainless steel, or an alloy. It will be appreciated, however, that the coupling member 60 can be formed from any of a variety of other suitable metals or other materials which can be selected on the basis of strength, durability, weight, chemical and heat resistance and other characteristics and design objectives. The elongated rod is shown to have a circular cross-section and to define a generally U-shape. More particularly, the hinge pin 62 is shown to define the hinge axis A and to extend longitudinally along the hinge axis A between a first location 64 and a second location 66. The arm 20 can be pivotable relative to the arm 40 about the hinge axis A, between an opened position (FIGS. 8-9) and a closed position (FIGS. 1-6), such that the arms 20 and 40 are in opened and closed positions, and such that the portable door propping apparatus 10 is in opened and closed positions, respectively. When the arms 20 and 40 are in the closed position as shown in FIGS. 1-6, the wings 22 and 42 can confront one another and together sandwich at least a portion of the hook 68.

The hook 68 is shown to include a first arcuate portion 70, a first longitudinally extending portion 72, a second arcuate portion 74, and a second longitudinally extending portion 76. The first arcuate portion 70 is shown to connect the hinge pin 62 (at second location 66) and the first longitudinally extending portion 72. The second arcuate portion 74 is shown to connect the first longitudinally extending portion 72 and the second longitudinally extending portion 76. It will be appreciated that a coupling member can be provided in any of a variety of other suitable alternative configurations.

Again referring to FIG. 7, the coupling member 60 can comprises a boss 78, shown in FIG. 7 to be adjacent to the second location 66. In addition, the coupling member 60 can define a stop pin aperture 80. More particularly, the stop pin aperture 80 is shown to be adjacent to the first location 64 and to extend transverse (e.g., perpendicularly) to the hinge axis "A". In the example of FIG. 7, the stop pin aperture 80 is shown to extend perpendicularly to the hinge axis "A". The stop pin aperture 80 can extend entirely through the coupling member 60, or only partly through the coupling member 60.

To assemble the portable door propping apparatus 10, the barrel members 26 and 46 of the respective arms 20 and 40 can be interdigitated such that the bores 28 and 48 are coaxially aligned, and the hinge pin 62 of the coupler member 60 can then be inserted through the bores 28 and 48 until the boss 78 contacts, or is adjacent to, an end surface 56 (FIG. 3) provided by the hub 44 of the arm 40. Then, a portion of a stop pin 82 (e.g., a roll pin, clevis pin, or cotter key) can be received within the stop pin aperture 80 in an interference fit, such that another portion of the stop pin 82 extends outwardly from the stop pin aperture 80. The outwardly extending portion of the stop pin 82 can contact, or be adjacent to, an end surface 36 (FIG. 3) provided by the hub 24 of the arm 20. In this configuration, the boss 78 and the stop pin 82 can cooperate to longitudinally restrain the coupling member 60 relative to the arms 20 and 40. In an alternative embodiment (not shown), in lieu of the boss 78, the coupling member 60 can define a second stop pin aperture, located adjacent to the second location 66, that is configured to receive a second stop pin. In another alternative embodiment (not shown), in lieu of the stop pin aperture 80 and the stop pin 82, the coupling member 60 can define a second boss (like 78), located adjacent to the first location 64, with the second boss being formed (e.g., by stamping or crimping) after the hinge pin 62 is inserted through the bores 28 and 48. It will be appreciated that any of a variety of suitable alternative mechanical arrangements can be provided to facilitate longitudinal retention of a coupling member relative to arms of a portable door propping apparatus.

Figure 8:
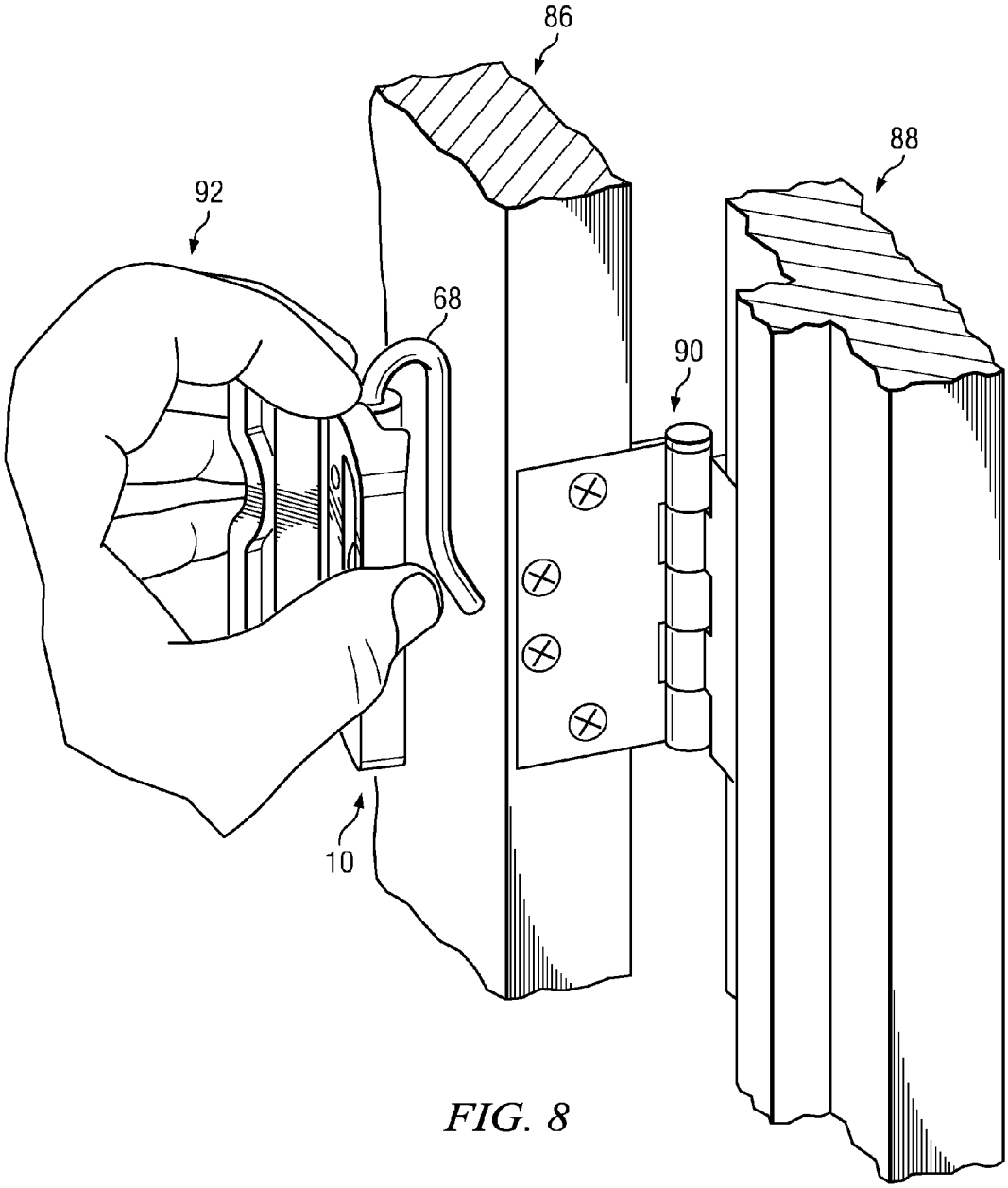
FIG. 8 is a perspective view depicting the portable door propping apparatus of FIG. 1 in combination with an operator's hand, a door, a door frame, and a hinge, wherein the portable door propping apparatus is in an opened position and is grasped by the operator's hand.

In one embodiment, the portion of the stop pin 82 extending outwardly from the stop pin aperture 80 can be configured to selectively contact respective surfaces 38 and 58 of the arms 20 and 40, to facilitate automatic centering of the hook 68 relative to the arms 20 and 40, when the arm 20 is in the opened position relative to the arm 40. It will be appreciated that "centering", when used in this context, shall mean that the hook 68 resides in a position located between the arms 20 and 40, and spaced from both of the arms 20 and 40, as generally shown in FIG. 8 for example, though not necessarily equidistant from both of the arms 20 and 40. Centering of the hook 68 relative to the arms 20 and 40, when the arms 20 and 40 are opened, can result in deployment of the hook 68 for convenient hanging of the portable door propping apparatus 10 upon a door hinge. The coupling member 60 can thus facilitate pivotal coupling of the arms 20 and 40, and can facilitate hanging of the portable door propping apparatus 10 on a door hinge, as discussed in further detail below. It will therefore be appreciated that, by simply grasping and fully opening the portable door propping apparatus 10 by an operator, the portable door propping apparatus 10 can be situated to efficiently interface a door hinge, without need for the operator to spend time verifying adjustment or other parameters of the portable door propping apparatus 10.

When the arms 20 and 40 are closed, the notches 23 and 43 can be aligned with and adjacent to one another, as generally shown in FIGS. 1-6, and configured to facilitate effective grasping of the portable door propping apparatus 10 by receiving a portion of a finger (e.g., an index finger or a thumb) of an operator's hand. When the arms 20 and 40 are opened, as shown in FIG. 8, the notches 23 and 43 can be configured to facilitate effective grasping of the portable door propping apparatus 10 by each receiving a portion of different fingers of an operator's hand. When the portable door propping apparatus 10 is retained within an operator's hand in the closed position, the operator can place his fingers within the notches 23 and 43 respectively provided by the arms 20 and 40, in order to facilitate rapid and quick movement of the arms 20 and 40 from the closed position to the opened position. In one embodiment, such as shown in FIGS. 1-2, the notches 23 and 43 can be elongated in one direction (e.g., such that the notches are generally in the shape of a half-heart) such as to facilitate simple grabbing of the portable door propping apparatus 10 by a gloved hand of an operator (e.g., a firefighter). It will be appreciated that arms of portable door propping apparatus can include any of a variety of other suitable configurations of notches to facilitate effective grasping of the portable door propping apparatus in opened and/or closed configurations.

Once assembled, in use, the portable door propping apparatus 10 can be selectively reconfigured between an opened position (FIGS. 8-9) and a closed position (FIGS. 1-6). It will be appreciated that, when the portable door propping apparatus 10 is in a closed position, it can have a compact and space-efficient shape to facilitate easy storage and carrying, such as in a pocket of clothing, firefighter turn-out gear, a belt holster, a tool box, a wall cabinet, and/or any of a variety of other locations or situations. From the closed position, an operator can easily and quickly reconfigure the portable door propping apparatus 10 to an opened position, such as by simply pivoting one or both of the arms 20 and 40 relative to the coupling member 60. In such a manner, the portable door propping apparatus 10 can be quickly and conveniently "flipped" open, to facilitate ready use by an operator. In one embodiment, the notches 23 and 43 can facilitate quick orientation of an operator's hand relative to the portable door propping apparatus 10. For example, a firefighter having a portable door propping apparatus 10 in a pocket of turn-out gear can, upon feeling for the presence of the notches 23 and 43, quickly orient the portable door propping apparatus 10 for use, even in dark, tense, and time-sensitive situations. For example, it can be seen in FIG. 8 that the notches 23 and 43 can enable the operator, through mere tactile interaction with the portable door propping apparatus 10, to assess and orient the portable door propping apparatus 10.

Figure 9:
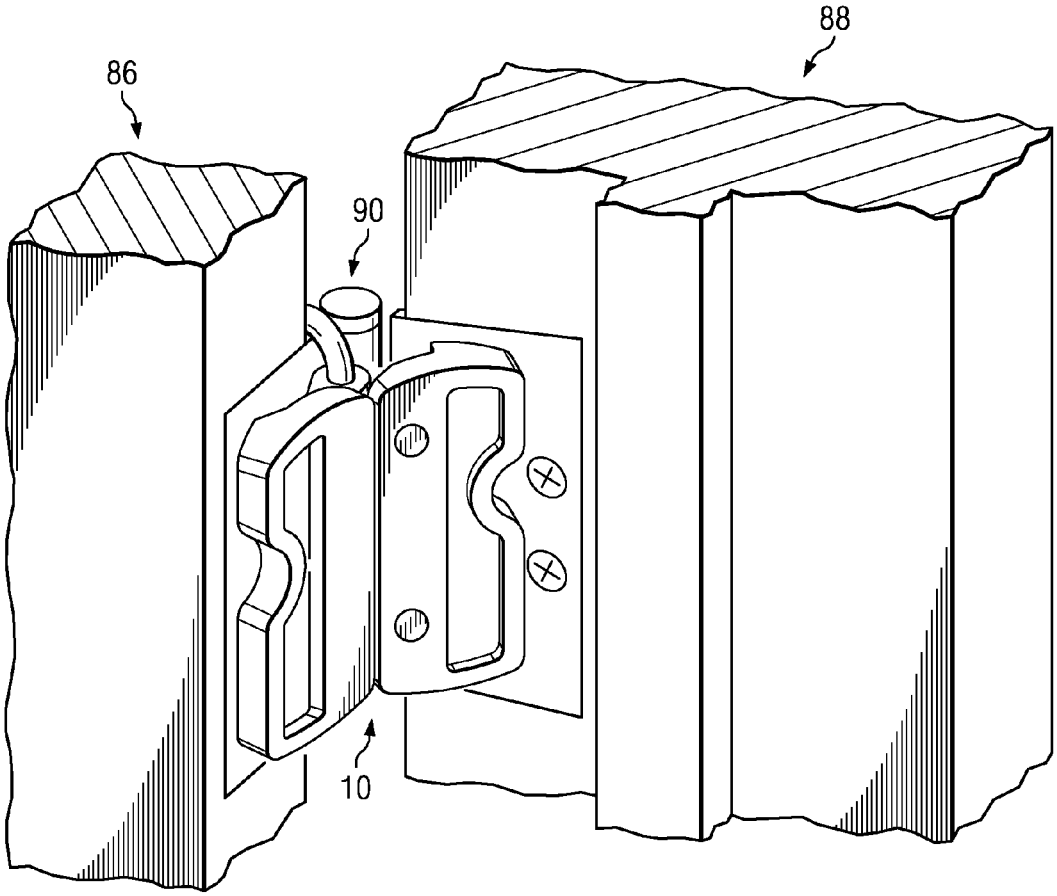
FIG. 9 is a perspective view depicting the items of FIG. 8, but with the operator's hand removed, and with the portable door propping apparatus hanging on the hinge and propping the door in an opened position.

An operator can associate the portable door propping apparatus 10 with a hinge of an existing door in order to temporarily or permanently block the door in an opened position. For example, as shown in FIGS. 8-9, the portable door propping apparatus 10 can be used to maintain a door 86 in an opened position with respect to a door frame 88 to which the door 86 is pivotally coupled by way of a plurality of hinges (e.g., 90). In use, an operator can grasp the portable door propping apparatus 10, and pivot one or both of the arms 20 and 40 from a closed position (FIGS. 1-6) to an opened position (FIGS. 8-9) about the hinge axis A. In so grasping, the operator can place respective fingers of a hand 92 into the respective notches 23 and 43 defined by the arms 20 and 40. The operator can then place the hook 68 over the hinge 90 such that a surface (e.g., 25 identified in FIG. 7) of the wing 22 of the arm 20 abuts the door frame 88, and a surface (e.g., 45 identified in FIG. 7) of the wing 42 of the arm 40 abuts the door 86, as shown in FIG. 9. With the portable door propping apparatus 10 installed as shown in FIG. 9, it will be appreciated that planar faces 39, 59 (FIGS. 5-6) of the respective wings 22, 42 can abut one another so that the wings 22, 42 can cooperate to form a rigid blocking member for propping open the door 86, such that the portable door propping apparatus 10 can prevent closing of the door 86 relative to the door frame 88. While the hook 68 of the portable door propping apparatus 10 is shown in FIG. 9 to extend over the arm of the hinge 90 that is attached to the door 86, it will be appreciated that the portable door propping apparatus 10 can prevent closing of the door 86 relative to the door frame 88 with the hook 68 instead extending over the arm of the hinge 90 that is attached to the door frame 88.

In one embodiment, a single portable door propping apparatus 10 can be used to hold open a door, even though the door might be hung relative to a jamb through use of multiple hinges. In another embodiment, such as when a door is biased closed through use of heavy springs, multiple portable door propping apparatus 10 might simultaneously be used, with each associated with a different hinge of the door. To remove the portable door propping apparatus 10, the hook 68 can be lifted from the hinge 90. The arms 20 and 40 can then be closed. When the portable door propping apparatus 10 is not in use, an operator can restrain the portable door propping apparatus 10 against a metal surface, such as a metal door frame or door, or other location convenient to the point of use, through use of the magnets 84, such as to facilitate effective storage of the portable door propping apparatus 10.

Alternatively, when the arms 20 and 40 of the portable door propping apparatus 10 are in a closed position, the portable door propping apparatus 10 can be used as a block or chock to prevent the door from closing. For example, the magnets 84 can hold the portable door propping apparatus 10 against the hinge 90, so that the portable door propping apparatus 10, in the closed position, can be sandwiched between the hinge 90, the door 86, and the door frame 88, to hold the door 86 slightly open relative to the door frame 88. Alternatively, the magnets 84 can hold the portable door propping apparatus 10, in the closed position, against an inside edge of the door frame 88 (when made of metal) or adjacent to a perimeter edge of the door 86 (when made of metal) at any of a variety of other suitable positions around the door 86 or the door frame 88, to become sandwiched between the door 86 and the door frame 88, to hold the door 86 slightly open relative to the door frame 88. With the door 86 held slightly open (e.g., one or more inches) relative to the door frame 88, it will be appreciated that extension cords or hoses can be passed through the opening, and/or the door 86 can be prevented from closing but while substantially blocking the passage of air, heat, cool, and/or light through the opening. It will accordingly be appreciated that the portable door propping apparatus 10 can be used in any of a variety of ways, both opened or closed, to prop a door in a slightly opened position (not shown) or a more fully opened position (e.g., FIG. 9).

Referring again to the example of FIGS. 8-9, if a firefighter were to encounter the door 86 in an emergency situation, the firefighter can withdraw the portable door propping apparatus 10 from his pocket and can quickly reconfigure the portable door propping apparatus 10 from the closed position to an opened position, and can then place the hook 68 over the hinge 90. The door 86 can then be held open by the portable door propping apparatus 10, as will be appreciated, such as with reference to FIG. 9. In particular, force that would normally close the door 86 relative to the door frame 88 can be transmitted through the arms 20 and 40, such that the portable door propping apparatus 10 can resist closing of the door 86.

Given the relatively compact size of the portable door propping apparatus 10, it will be appreciated that a firefighter can carry multiple portable door propping apparatus 10 in his pocket at any given time. In one embodiment, the portable door propping apparatus 10 can be configured for repeated use, namely by simply removing the portable door propping apparatus 10 from the hinge (e.g., 90) following use, and then storing the portable door propping apparatus 10 for future use. In another embodiment, the portable door propping apparatus 10 can be manufactured relatively inexpensively as to justify disposing of the portable door propping apparatus 10 after any single use, or after exposure to severe heat, chemicals, excessive or prolonged force, or other damage.

While the portable door propping apparatus 10 might be particularly useful by firefighters and other emergency service personnel as described above, it will be appreciated that the portable door propping apparatus 10 can be useful in a variety of other situations. For example, movers, truckers, contractors, delivery personnel, construction workers, homeowners, custodians, maintenance personnel, police officers, emergency medical technicians, paramedics, military personnel, and others can use the portable door propping apparatus 10 in their daily routine, in order to prevent inadvertent or undesired closing of a door behind them. In one embodiment, the portable door propping apparatus 10 can be provided with a protective sheath from which the portable door propping apparatus 10 can be removed prior to use. One or more apertures can be provided in one or more arms of a portable door propping apparatus such as to reduce weight of the portable door propping apparatus, and/or to facilitate hanging of the portable door propping apparatus on a belt or coat hook. Alternatively, a pin or hook of a portable door propping apparatus can form an aperture (not shown) suitable to facilitate hanging of the portable door propping apparatus on a belt or coat hook.

Figure 10:
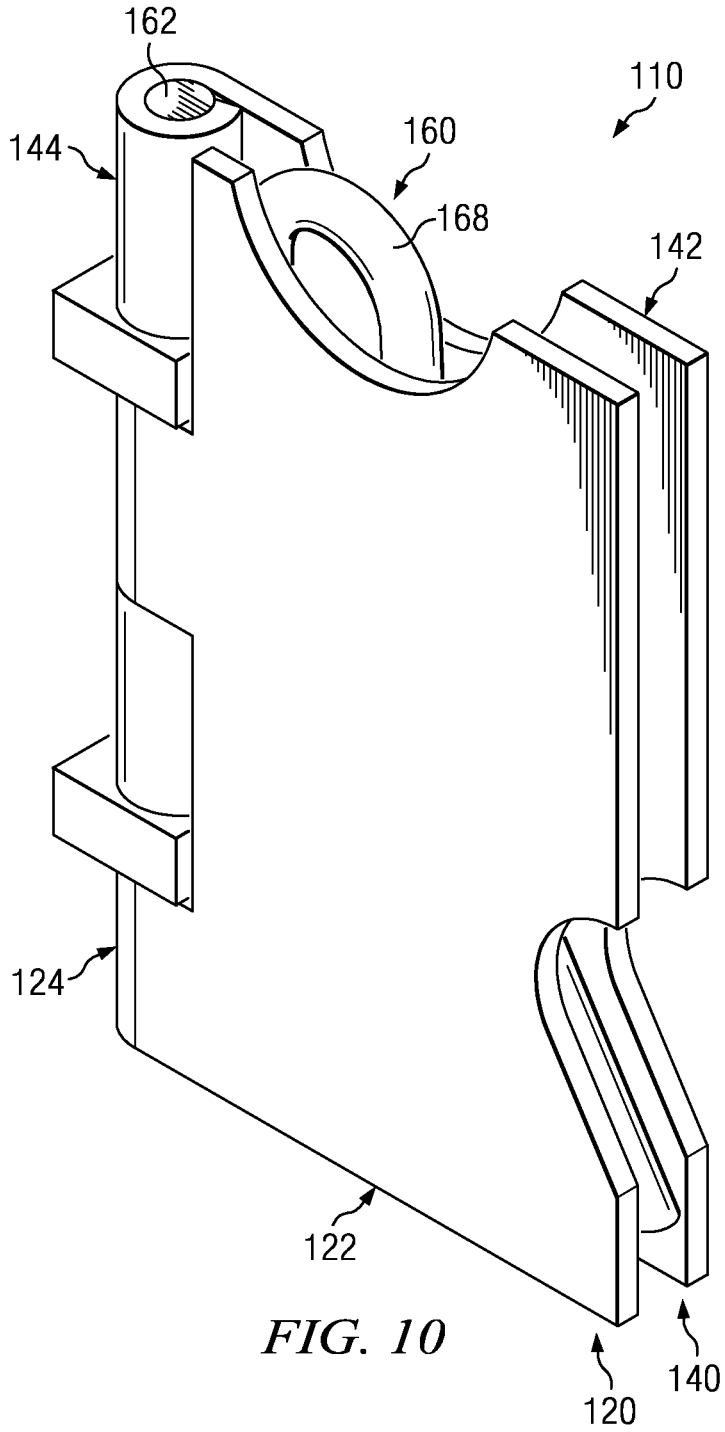
FIG. 10 is a perspective view depicting a portable door propping apparatus in accordance with another embodiment, wherein the portable door propping apparatus is in a closed position.
Figure 11:
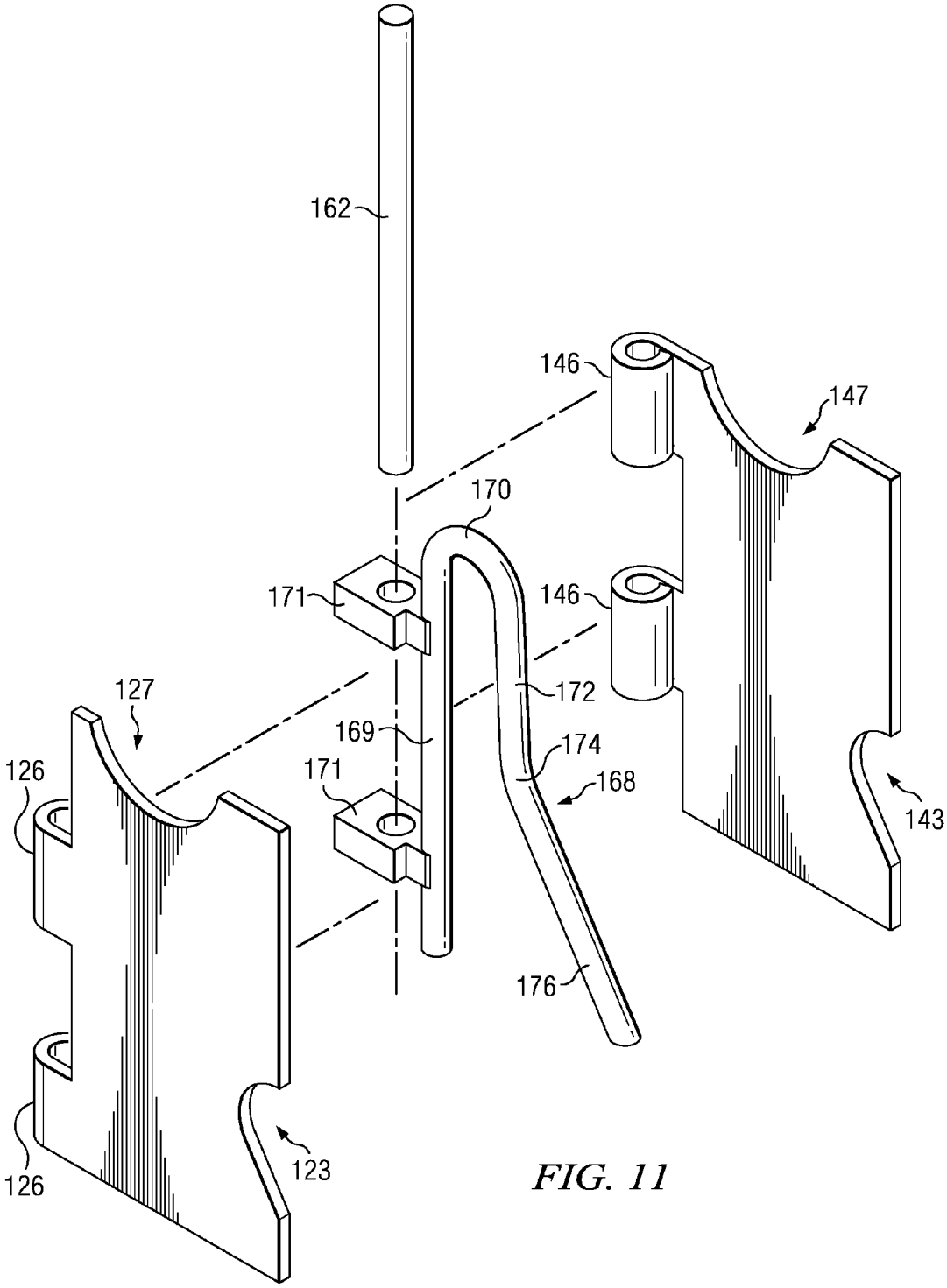
FIG. 11 is an exploded perspective view depicting the portable door propping apparatus of FIG. 10.
Figure 12:
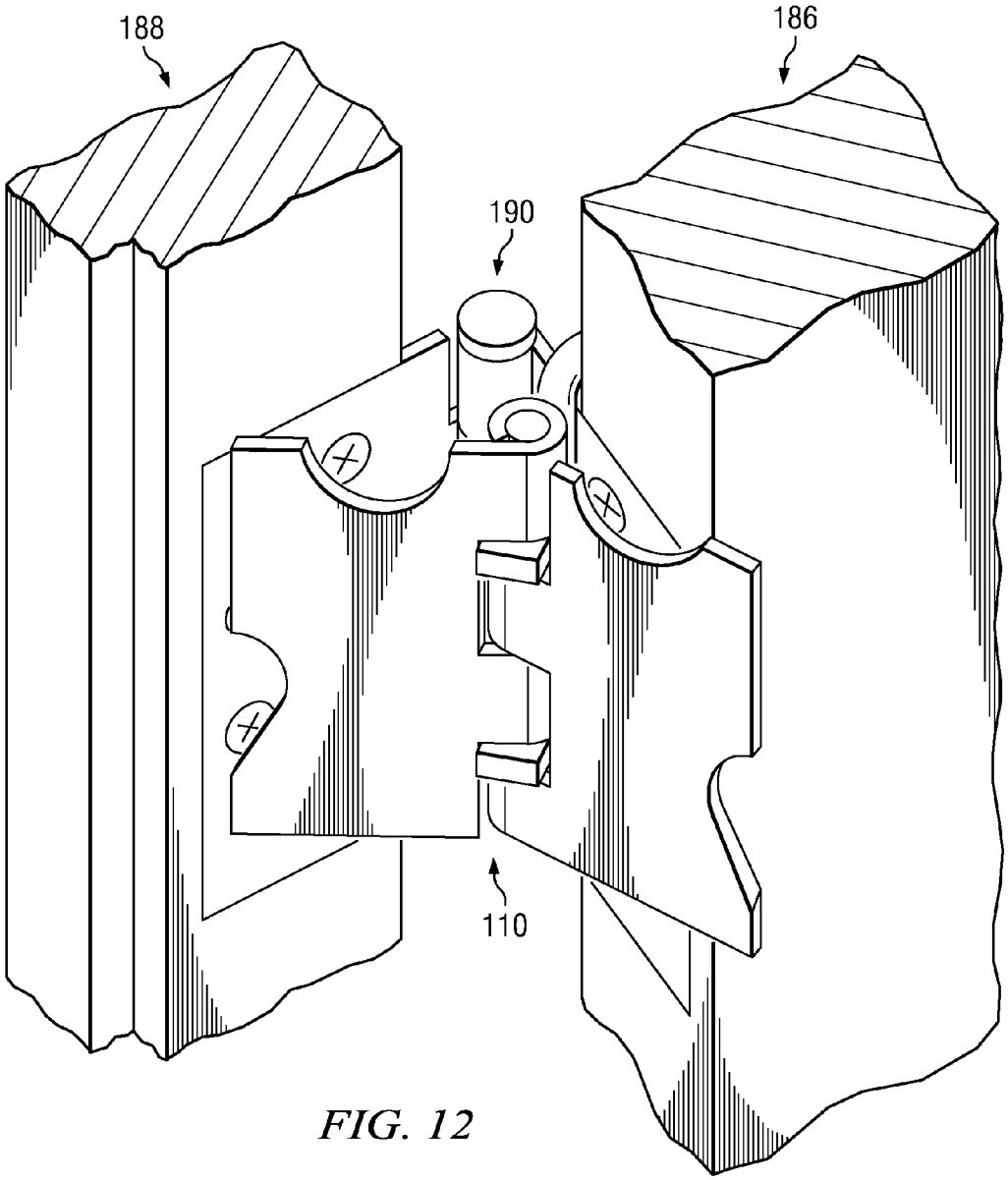
FIG. 12 is a perspective view depicting the portable door propping apparatus of FIG. 11 in combination with a door, a door frame, and a hinge, wherein the portable door propping apparatus is in an opened position, is hanging on the hinge, and is propping the door in an opened position.

It will be appreciated that a portable door propping apparatus can have any of a variety of other suitable configurations. For example, a portable door propping apparatus 110 in accordance with an alternative embodiment is depicted in FIGS. 10-12. The portable door propping apparatus 110 is shown to comprise arms 120 and 140 and a coupling member 160. The coupling member 160 can include a hinge pin 162 and a hook 168. The hinge pin 162 is shown to comprise a straight section of metal wire. In an alternative embodiment, a hinge pin can be provided with a head which has a diametric dimension greater than the diametric dimension of the remainder of the hinge pin.

The arm 120 is shown to comprise a sheet of metal which is formed (e.g., by stamping and then rolling) to define a wing 122 and a hub 124, with the hub 124 having two barrel members 126 and with the wing 122 defining notches 123 and 127. Likewise, the arm 140 is shown to comprise a sheet of metal which is formed to define a wing 142 and a hub 144, with the hub 144 having two barrel members 146 and with the wing 142 defining notches 143 and 147. In an alternative embodiment, a hub of an arm of a portable door propping apparatus can comprise more than, or fewer than, two barrel members. Each of the barrel members 126 and 146 is shown to define a bore.

The hook 168 is shown to include blocks 171, a longitudinally extending attachment portion 169, and an overhang portion. The overhang portion is shown to include a first arcuate portion 170, a first longitudinally extending portion 172, a second arcuate portion 174, and a second longitudinally extending portion 176. The first arcuate portion 170 is shown to connect the attachment portion 169 and the first longitudinally extending portion 172. The second arcuate portion 174 is shown to connect the first longitudinally extending portion 172 and the second longitudinally extending portion 176. It will be appreciated that a coupling member can be provided in any of a variety of other suitable alternative configurations.

In one embodiment, as shown in FIGS. 10-12, the attachment portion 169 and the overhang portion can be formed as a unitary structure such as from a piece of metal wire. In another embodiment, it will be appreciated that an attachment portion can be formed from, and attached to, an overhang portion, such as through use of welding, adhesives, fasteners, and/or any of a variety of other suitable techniques or arrangements. The blocks 171 are shown to be formed from metal plate and to be welded to the attachment portion 169 at respective locations spaced from one another. Each of the blocks 171 is shown to define a respective bore. It will be appreciated that a hook can include blocks provided in any of a variety of other suitable arrangements.

To assemble the portable door propping apparatus 110, the arms 120 and 140 can be positioned relative to the hook 168 such that bores defined by the barrel members 126 align with bores defined by the barrel members 146 and bores defined by the blocks 171. Then, the hinge pin 162 can be inserted into the aligned bores. In one embodiment, the hinge pin 162 can be secured in place, for example, by punching or crimping one or more of the barrel members 126 and 146, and/or one or more of the blocks 171, once the hinge pin 162 is inserted through the aligned bores. In another embodiment, the hinge pin 162 can be removably retained within the aligned bores such as through use of an interference or friction fit. In still another embodiment, as previously indicated, a hinge pin can be provided with a head configured to abut one of the barrel members 126 and 146 when the hinge pin is fully seated with respect to the aligned bores. Once the portable door propping apparatus 110 is assembled, it can appear as shown in FIGS. 10 and 12. It will be appreciated that the blocks 171 can be configured such that, when the portable door propping apparatus 110 is in a fully opened position, the arms 120 and 140 can contact the blocks 171 such that the hook 168 is generally centered relative to, and perhaps even equally spaced from, each of the arms 120 and 140.

Figure 13:
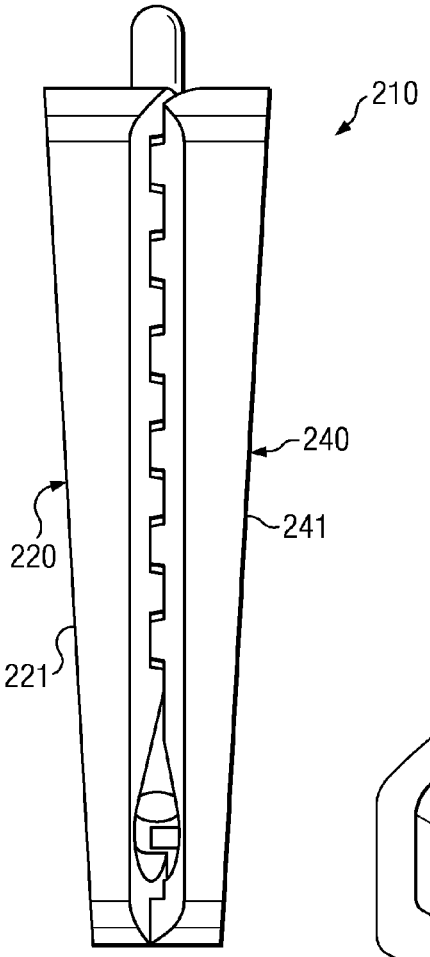
FIG. 13 is a rear elevational view depicting a portable door propping apparatus in accordance with yet another embodiment, wherein the portable door propping apparatus is in a closed position.

In another embodiment, exterior surfaces 221 and 241 of arms 220 and 240 of a portable door propping apparatus 210 can be configured such that, when the portable door propping apparatus 210 is in a closed position, as shown in FIG. 13, the portable door propping apparatus 210 can have a wedge shape, at least in some respect typical of a conventional wooden or rubber door stop or chock. In such a configuration, the portable door propping apparatus 210, in its closed position, can itself be wedged beneath a door and a ground surface, or between a door and a door frame, in a manner of use typical of conventional wooden door stops or chocks. When wedged beneath a door in this manner, one of the arms 220 and 240 can abut the door, while the other one of the arms 220 and 240 can abut a ground surface. Therefore, the portable door propping apparatus 210, when either opened or closed, can be configured to prop open a door, thus providing the portable door propping apparatus with enhanced versatility and multi-use capability. Other than with respect to the shape of the arms 220 and 240 in this regard, the portable door propping apparatus 210 can be generally similar to that shown and described above with respect to the portable door propping apparatus 10.

Figure 14:
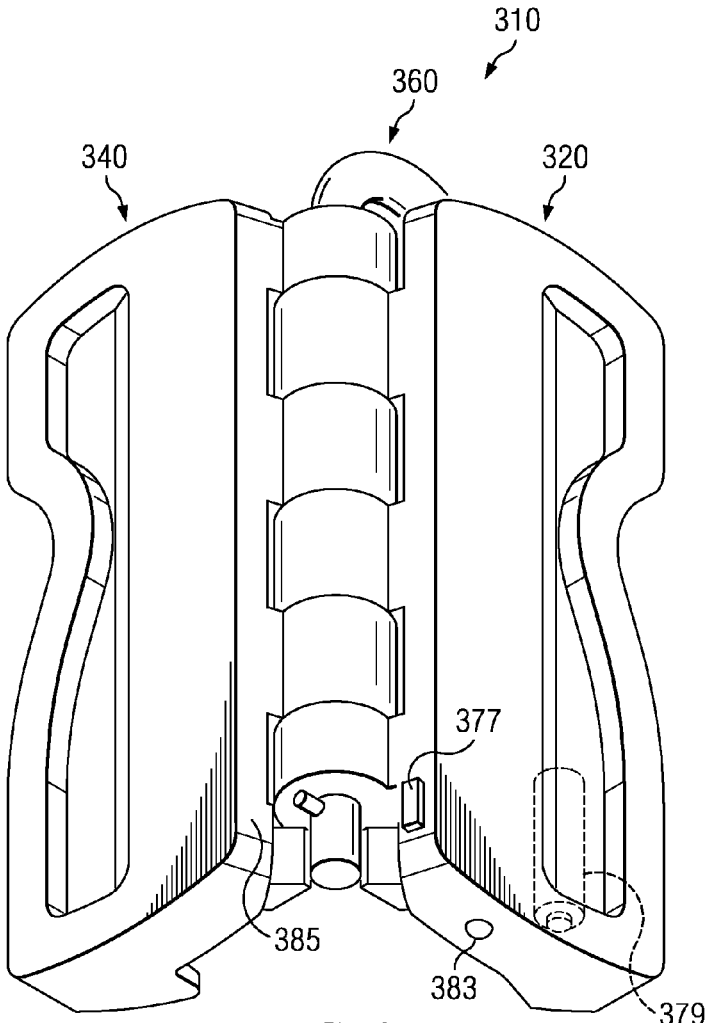
FIG. 14 is a perspective view depicting a portable door propping apparatus in accordance with still another embodiment, wherein the portable door propping apparatus is in an opened position.

A portable door propping apparatus 310 in accordance with yet another alternative embodiment is depicted in FIG. 14 and can be similar to the portable door propping apparatus 10 described above, except that the portable door propping apparatus 310 can additionally include an indication system. More particularly, the portable door propping apparatus 310 can include arms 320 and 340 that are pivotally coupled by a coupling member 360. The indication system is shown to be associated with the arm 320 and to include a switch 377, an illumination source 383, and a battery 379. When the portable door propping apparatus 310 is in a fully opened position, a surface 385 of the arm 340 can contact the switch 377, thus causing the switch 377 to complete an electrical circuit between the illumination source 383 and the battery 379, resulting in powering and illumination of the illumination source 383. The illumination source 383 can comprise an incandescent light bulb or a light emitting diode ("LED"), for example. In an alternative embodiment, in lieu of the switch 377, a proximity detector or other component(s) can be provided to detect when the portable door propping apparatus 310 is in a fully opened position. In one embodiment, the illumination source 383 can be configured to flash or blink when the portable door propping apparatus 310 is in a fully opened position. Operation of the illumination source 383 can help a firefighter recognize a doorway in smoky conditions, and can also help to remind an operator to remove the portable door propping apparatus 310 after use. The battery 379, the illumination source 383 and related components can be at least partially disposed within one or more cavities that are molded into one or both of the arms.

A portable door propping apparatus can be provided in any of a variety of other suitable configurations, such as for example which include two arms which are pivotally coupled and a hook for interfacing a door hinge, it being understood that the portable door propping apparatus 10, 110, 210, and 310 are merely examples of the many suitable varieties of portable door propping apparatus that are capable of manufacture and use in accordance with the teachings herein.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto.

What is claimed is:

1. A portable door propping apparatus, comprising:

a first arm comprising a first wing and a first hub, the first wing comprising a first planar face, and the first hub defining a first bore;

a second arm comprising a second wing and a second hub, the second wing comprising a second planar face, and the second hub defining a second bore; and a coupling member comprising a hinge pin and a hook, the hinge pin defining a hinge axis and extending into each of the first bore and the second bore; wherein the first arm is pivotable relative to the second arm about the hinge axis, between an opened position and a closed position;

when the first arm is in the opened position, the hook is configured to hang on a door hinge with the first planar face of the first wing and the second planar face of the second wing abutting one another and with the first wing and the second wing cooperating to form a rigid blocking member for propping open a door; and when the first arm is in the closed position, the first wing and the second wing confront one another and together sandwich at least a portion of the hook.

2. The portable door propping apparatus of claim 1, wherein the hinge pin and the hook are formed as a unitary structure.

3. The portable door propping apparatus of claim 2, wherein the coupling member comprises an elongated metal rod having a circular cross-section and defining a generally U-shape, the elongated metal rod defining each of the hinge pin and the hook.

4. The portable door propping apparatus of claim 3, wherein:

the hook comprises a first arcuate portion, a first longitudinally extending portion, a second arcuate portion, and a second longitudinally extending portion;

the first arcuate portion connects the hinge pin and the first longitudinally extending portion; and the second arcuate portion connects the first longitudinally extending portion and the second longitudinally extending portion.

5. The portable door propping apparatus of claim 4, further comprising a stop pin, wherein:

the hinge pin extends along the hinge axis between a first location and a second location;

the coupling member defines a stop pin aperture adjacent to the first location and extending transverse to the hinge axis; and the coupling member further comprises a boss disposed adjacent to the second location;

a first portion of the stop pin is received within the stop pin aperture in an interference fit; and the boss and the stop pin cooperate to longitudinally restrain the coupling member relative to the first arm and the second arm.

6. The portable door propping apparatus of claim 5, wherein a second portion of the stop pin extends outwardly from the stop pin aperture and is configured to selectively contact at least one of the first arm and the second arm, to facilitate centering of the hook relative to the first arm and the second arm, when the first arm is in the opened position relative to the second arm.

7. The portable door propping apparatus of claim 3, wherein:

the first bore is coaxially aligned with the second bore;

the first hub comprises a plurality of first barrel members spaced from one another longitudinally along the hinge axis and each defining a respective portion of the first bore; and the second hub comprises a plurality of second barrel members spaced from one another longitudinally along the hinge axis, interdigitated relative to respective ones of said first barrel members, and each defining a respective portion of the second bore.

8. The portable door propping apparatus of claim 3, wherein:

the first arm comprises plastic;

the second arm comprises plastic; and the coupling member comprises metal.

9. The portable door propping apparatus of claim 3, further comprising a magnet attached to the first wing.

10. The portable door propping apparatus of claim 1, wherein:

the first wing defines a first notch;

the second wing defines a second notch; and when the first arm is in the closed position relative to the second arm, the first notch and the second notch are aligned with and adjacent to one another, and are configured to facilitate grasping of the portable door propping apparatus by receiving a portion of a finger of an operator's hand;

when the first arm is in the opened position relative to the second arm, the first notch and the second notch are configured to facilitate grasping of the portable door propping apparatus by each receiving a portion of different fingers of an operator's hand.

11. The portable door propping apparatus of claim 10, wherein:

the first arm extends vertically from a first top edge to a first bottom edge and horizontally from a first side edge to a second side edge, each of the first top edge and the first bottom edge extends to each of the first side edge and the second side edge, the first hub defines at least a portion of the first side edge, and the first notch defines at least a portion of the second side edge; and the second arm extends vertically from a second top edge to a second bottom edge and horizontally from a third side edge to a fourth side edge, each of the second top edge and the second bottom edge extends to each of the third side edge and the fourth side edge, the second hub defines at least a portion of the third side edge, and the second notch defines at least a portion of the fourth side edge.

12. The portable door propping apparatus of claim 1, wherein:

the first arm comprises plastic;

the second arm comprises plastic; and the coupling member comprises metal.

13. The portable door propping apparatus of claim 12, wherein:

the first arm comprises fiberglass-reinforced plastic;

the second arm comprises fiberglass-reinforced plastic; and the coupling member comprises hardened steel.

14. The portable door propping apparatus of claim 1, wherein when the first arm is in the closed position relative to the second arm, the first arm cooperates with the second arm to define a wedge-shape.

15. A method of propping a door in an opened position relative to a door frame, the door being pivotally coupled to the door frame by at least one door hinge, the method comprising:

pivoting a first arm of a portable door propping apparatus, from a closed position to an opened position, relative to a second arm of the portable door propping apparatus, about a hinge axis, wherein the first arm comprises a first wing and a first hub, the first wing comprises a first planar face, the first hub defines a first bore, the second arm comprises a second wing and a second hub, the second wing comprises a second planar face, the second hub defines a second bore, the hinge axis is defined by a hinge pin of a coupling member of the portable door propping apparatus and extends into each of the first bore and the second bore, and the coupling member further comprises a hook extending into a space defined between the first arm and the second arm when the first arm is in the closed position; and when the first arm is in the opened position, hanging the hook on the door hinge such that the first arm abuts the door and the second arm abuts the door frame, with the first planar face of the first wing and the second planar face of the second wing abutting one another and with the first wing and the second wing cooperating to form a rigid blocking member which props open the door.

16. The method of claim 15, further comprising grasping the first arm and the second arm, said grasping comprising placing a portion of a finger of an operator's hand into respective notches defined by the first arm and the second arm.

17. The method of claim 15, further comprising retaining the portable door propping apparatus against a metal object through use of a magnet attached to the first arm.

18. The method of claim 15, further comprising removing the hook from the door hinge, pivoting the first arm from the opened position to the closed position relative to the second arm, and wedging the portable door propping apparatus beneath the door such that the first arm abuts the door and the second arm abuts a ground surface.

* * * * *